United States Patent [19]

Hodges

[11] Patent Number: 4,628,844

[45] Date of Patent: Dec. 16, 1986

[54] APPARATUS FOR TRANSPORTING FABRIC PIECES

[75] Inventor: Michael J. Hodges, High Wycombe, England

[73] Assignee: Detexomat Machinery Limited, Buckinghamshire, England

[21] Appl. No.: 724,246

[22] Filed: Apr. 17, 1985

Related U.S. Application Data

[63] Continuation-in-part of Ser. No. 693,471, Jan. 22, 1985, abandoned.

[30] Foreign Application Priority Data

Apr. 17, 1984 [GB] United Kingdom ..... 8409884

[51] Int. Cl.[4] ..... D05B 33/00; D06G 3/04

[52] U.S. Cl. ..... 112/121.15; 223/43

[58] Field of Search ..... 223/1, 43, 41, 75; 112/121.15

[56] References Cited

U.S. PATENT DOCUMENTS

| | | | |
|---|---|---|---|
| 2,905,366 | 9/1959 | Shoaf | 223/43 X |
| 4,364,320 | 12/1982 | Nakhle | 112/121.15 X |
| 4,434,918 | 3/1984 | Hodges | 223/75 |
| 4,444,140 | 4/1984 | Moyer | 112/121.15 X |
| 4,487,546 | 12/1984 | Cassinelli | 223/41 X |
| 4,541,351 | 9/1985 | Horita et al. | 223/43 X |
| 4,550,868 | 11/1985 | Hodges et al. | 112/121.15 X |

FOREIGN PATENT DOCUMENTS

| | | |
|---|---|---|
| 2211951 | 7/1974 | France . |
| 2081316 | 2/1982 | United Kingdom . |
| 2013738 | 4/1982 | United Kingdom . |

*Primary Examiner*—Louis K. Rimrodt

*Attorney, Agent, or Firm*—Dority & Manning

[57] ABSTRACT

Transfer of garments, having limp portions, from one machine (L) to another machine (T) the needs of which demand that the limp portions are separate for delivery to separate receiving members therefor, is accomplished while the garments are moving in the direction of the receiving machine (T). The limp portions of the moving garment are draped over a guide rail (28); a second guide rail (30) is encountered by the limp portions, this rail being positioned to interpose itself between the advancing limp portions, with the result that one limp portion becomes draped over each rail.

25 Claims, 4 Drawing Figures

APPARATUS FOR TRANSPORTING FABRIC PIECES

Figure 1:
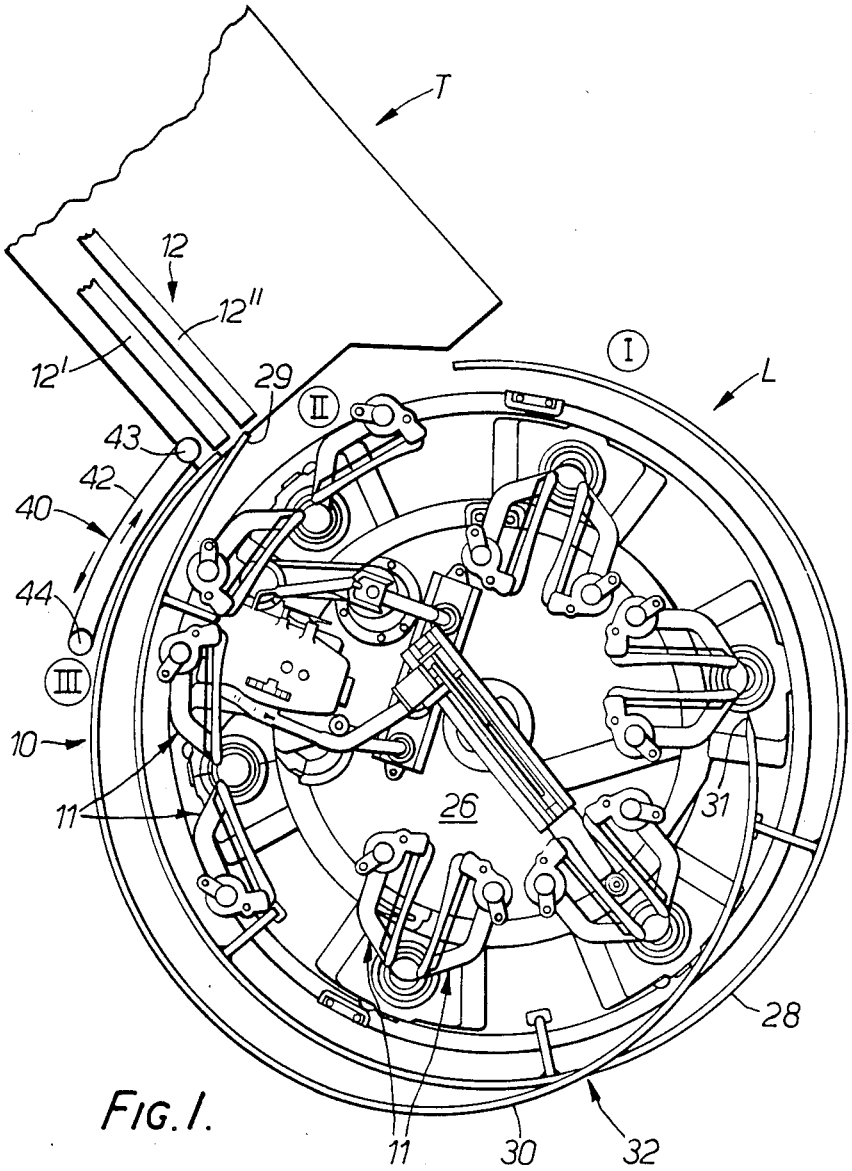

This is a continuation-in-part of application Ser. No. 693,471, filed Jan. 22, 1985 in the name of Michael John Hodges, entitled APPARATUS FOR TRANSPORTING FABRIC PIECES now abandoned.

The present invention relates to apparatus for transporting fabric pieces. The fabric pieces can be garment articles needing transporting from one work-station to another in a mill. The apparatus to be described in detail hereinafter was developed with the hosiery-manufacturing industry particularly in mind.

The manufacture of hosiery starts with the knitting of open-ended leg blanks. At a subsequent stage their toe ends are closed and various finishing operations such as dyeing, boarding and packing are performed. When manufacturing pantihose, pairs of legs are joined together, most frequently after toe closing. Typically, hose legs are mounted on leg supports for the various operations to be performed thereon. Commonly, hose manufacture involves several mountings/dismountings of hose on different leg supports. At least the mounting steps are accomplished in greater or smaller extent by hand. Such manual operations are time consuming, especially if hose have to be everted during the mounting, and with every manual handling the risk of damaging fragile knits increases.

When making pantihose, separate legs are normally subjected to toe closing and are collected for supply to the operator whose job is to attend to joining legs together pairwise. This operator may be in charge of an automatic line closer which accomplishes the leg-joining operation. Amongst the drawbacks of operating in this fashion is the need for the operator to load toe-closed hose legs onto the leg supports of the line closer.

Toe closers are now available which enable paired legs, presented in the form of made-up pantihose, to be toe closed at effectively the same time. Two such machines are the Pantimatic toe closer and the Speedomatic HS manufactured by Detexomat Machinery Limited. (PANTIMATIC, SPEEDOMATIC and DETEXOMAT are Registered Trade Marks). With such machines as these, it can be beneficial to line close first and then to toe close.

The apparatus we have devised assists in the transport of limp fabric workpieces to a receiving station or machine having a receiving member such as a support upon which the workpieces are to be mounted e.g. pneumatically or by means of suction. The apparatus is intended primarily, but not exclusively, to deliver the legs of part-finished pantihose from the hose supports of a hosiery line closer directly to the suction tubes of the leg supports of a toe closer. The apparatus serves to maintain portions of the workpiece, e.g. the legs of pantihose, separate from one another during their transport, and positively advances, each portion so that they can be properly received and handled by the receiving station or machine.

Whilst the plural limp portions of a garment have to be kept separate, at least during their final approach to the work station having the separate receiving members therefor, we have found that for successful, expeditious delivery of the limp portions to their allotted receiving members, the said portions should be smoothly and positively driven individually to the receiving members. We have found that optimum control of the limp portions is only attained in practice if smooth-running and easily-controllable endless loop conveyors are employed to drive the limp portions. The linear speed of such conveyors is easy to control and by this means proper timing of the operation of equipment featuring the invention is substantially facilitated.

In its broadest aspect, the present invention provides a method of conveying a garment having limp portions to a work station having separate receiving members each allotted to a respective one of the limp portions, the said portions being advanced separately from one another during their passage to the work station, characterised in that at least in their final approach to the work station, the limpportions are each engaged by respective endless loop conveying means, and thereupon each limp portion is individually and positively advanced in a controlled manner to its allotted receiving member.

The invention also provides a method of conveying a garment having separate limp portions to a work station having separate receiving members for the limp portions, each allotted to a respective one of said portions, characterised in that consequential upon moving the garment in the direction of said station, the limp portions are displaced relative to each other, thereby separating them, by causing them to move along different, diverging paths each leading to a respective one of the separate receiving members and in that each separated limp portion is engaged by an endless loop conveying means, at least as it approaches a downstream end of its path of travel, and is positively advanced by said conveying means along its path in a controlled manner to its respective receiving member.

The method defined in either of the last two paragraphs can be performed in conjunction with operatively juxtaposed line and toe closers used for the production of pantihose. The method can be performed also in conjunction with operatively-juxtaposed line closers and suction everters, line closers and gusset inserting machines, and line closers and boarding machines, for instance.

The present invention also provides garment handling apparatus operable on garments moving between two work stations, wherein said garments have adjacent limp portions to be delivered individually to separate receiving members at the receiving station, characterized in that the apparatus comprises means to advance the garments towards the receiving members, and respective endless loop conveying means positioned for engagement with each limp portion during at least the final approach of the garment to the receiving members, the conveying means being operative positively to advance the associated limp portions individually in a controlled manner along predetermined respective paths therefor to their allotted receiving members.

Also according to the present invention, there is provided garment handling apparatus operable on garments moving between two work stations wherein said garments have adjacent limp portions to be delivered separated from one another to separate receiving members at the receiving station, characterised in that the apparatus comprises means to advance the garments along a path of movement towards the receiving members, elongate guide means extending to the receiving members which guide means have a configuration that, consequential on the movement of the garments therealong, is operative to effect a relative separating displacement of their limp portions, and respective endless loop conveying means which engage and frictionally grip each limp portion during at least the final approach of a garment to the receiving members, the conveying means being operative positively to advance the associated limp portions individually in a controlled manner along predetermined respective paths to their allotted receiving members.

The aforesaid guide means can comprise two rails, at least one of which is located in or adjacent the said path for interposition between the two limp portions, and the said rails being generally divergent for spreading the lining portions apart. One rail can parallel the path of movement while the other diverges therefrom.

The positive drive afforded by the endless loop conveying means ensures the limp portions are delivered to the receiving members in a properly timed sequence suiting the overall machine operation, and proper timing can be attained readily by appropriately adjusting the linear speeds of the individual conveying means.

Although this apparatus is primarily meant for handling pantihose articles it could handle other limp articles having related portions, such as trousers, shirts, jackets, sweaters and cardigans.

The preferred application of the present apparatus is to assist operative interconnection of two machines which perform sequential work operations on hose, for instance a pantihose line closer and a toe closer or a line closer and a gusset inserting machine. The apparatus according to the invention enables each hose leg of a joined pair thereof to be presented correctly to a respective one of a pair of adjacent suction tubes of a hose everting or mounting device, of a toe closer, for instance. Desirably there will be an associated mechanism to strip hose bodies from the line closer and to deposit them on the suction tubes.

A preferred pantihose manufacturing equipment comprises (a) a line closer for receiving a pair of hose leg blanks on hose holders thereof, said holders being movable along a predetermined path to advance the blanks first past a seamer which is operative to join said blanks to form a pantihose body portion, and then to a transfer station; (b) apparatus as defined hereinbefore for advancing limp, leg portions of the blanks positively and controllably to the transfer station; (c) a suction everter e.g. of a toe closer adjacent said transfer station for receiving the pantihose garment, e.g. in readiness for closing toe ends of the legs thereof, the everter having a pair of suction tubes each to receive therein, by suction, a respective garment leg positively advanced thereto by the conveying means; and (d) a transfer mechanism at the transfer station which is operative (i) to strip the body portion of the garment from the line closer holders and (ii) to carry said body portion to the suction tubes and to dispose the body portion around said tubes in an everted condition.

The transfer mechanism can be operative to take hold of the said body portion and to strip it from the line closer holders before the legs are presented to the suction tubes.

Figure 2:
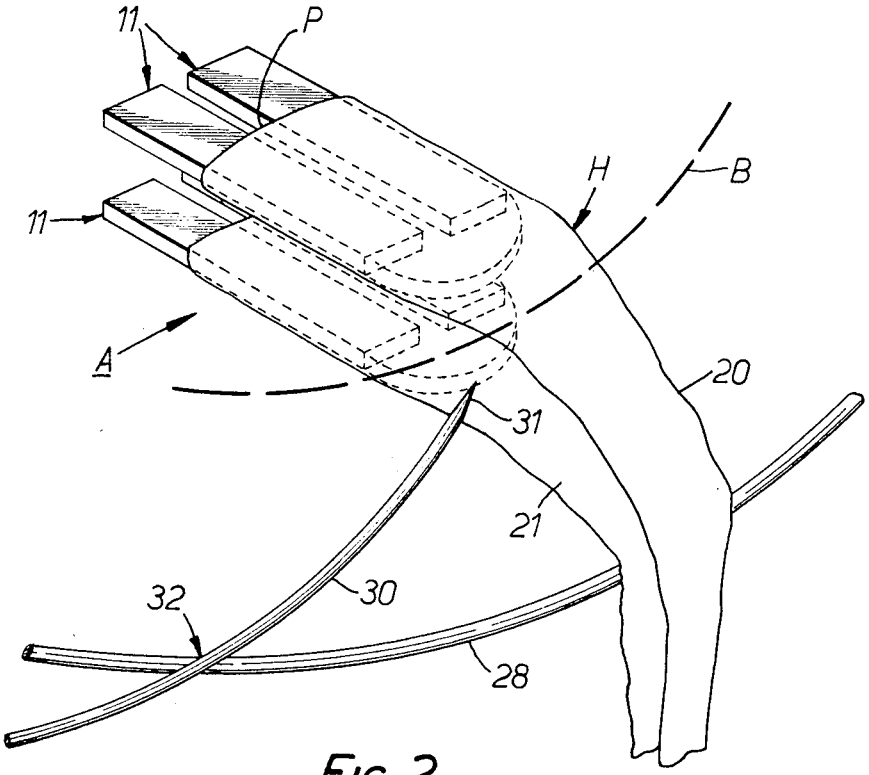
Figure 3:
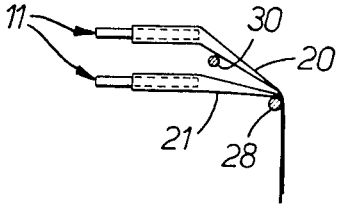
Figure 4:
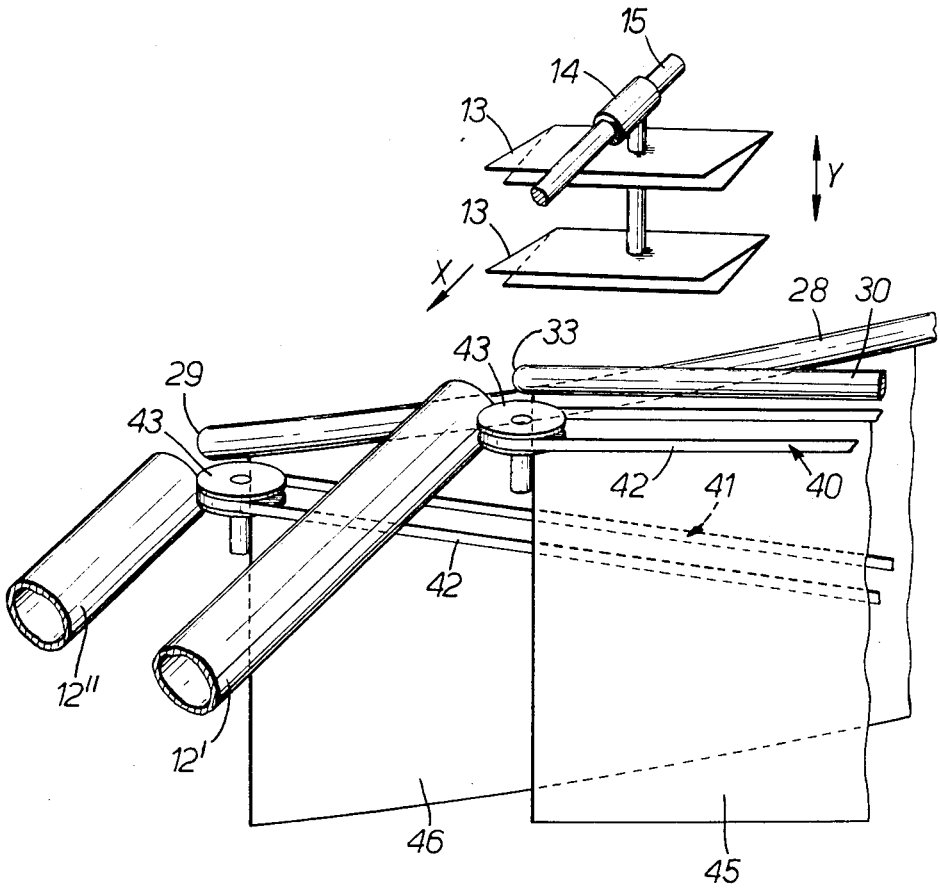

The invention will now be described by way of example only with reference to the accompanying drawings, in which:

FIG. 1 is a general arrangement in plan view showing apparatus according to the invention for transporting hose between the leg supports of two hosiery machines, FIG. 2 is a perspective view of part of the apparatus shown in FIG. 1, FIG. 3 is a side elevational view of the apparatus as seen in the general direction of Arrow A in FIG. 2, and FIG. 4 is a fragmentary perspective view of a delivery end of the apparatus according to the invention.

The apparatus according to the invention shown in FIG. 1 is for transporting or guiding the legs of part-finished pantihose mounted on support means 11 of a line closer L to a pair of adjacent supports 12 of a toe closer T. One such line closer is made by Takatori Machinery Works Limited of Yamatotakada City, Japan, under several model numbers LC-240, LC-280 and LC-320. Exemplary toe closers are noted hereinbefore.

The apparatus being described ensures the hose legs reach the supports 12 of the toe closer T in such a manner that each hose leg is presented properly to the correct one of said supports 12.

The line closer L has a plurality of hose supporters mounted at intervals about a horizontal carousel which rotates around a vertical central axis. Each supporter comprises a pair of leg supports 11, designed to hold two knitted legs to be joined. These supports 11 are parallel and adjacent at a loading station I of the line closer L. In FIG. 1 a hose supporter is shown in an open condition at a discharge station II. Following discharge, the leg supports are moved parallel and close to one another again ready for receiving new hose. In the course of their travel from statin I to station II, the leg supports 11 are spread apart, properly to present the hose legs thereon to cutting and seaming means at station III. It is at this station that the legs are joined by a crutch or body seam.

The general organisation and operation of the line closer L will be known to the addressee. Therefore a detailed explanation is omitted. Explanation of parts of the line closer as may be needed for an understanding of the present invention will be given, however, as this description proceeds.

At the toe closer, the joined legs are to be presented by the apparatus 10 to the mouths of two parallel and adjacent suction tubes 12', 12'' of a hose support 12 of the toe closer. Desirably it is the toe end portion which is presented first to the suction tubes 12', 12'', but it does not matter if the portion of the hose presented thereto is not actually the toe end. The body part of the pantihose is, however, to be drawn over or around the support 12. In the commercial toe closers mentioned above, there are several such supports 12. Each comprises two suction tubes which are flanked by a respective pair of flat, diametrically-opposed blades (not shown). The requirement for the toe ends and legs reliably to enter the correct suction tubes 12', 12'' of support 12 has created the need for the present apparatus 10.

Means for stripping the body portion of a part-finished pantihose H from a supporter of the line closer L and for loading the body portion onto a toe closer support 12 are not illustrated in FIG. 1, to avoid over-complicating the drawing. An exemplary stripping and loading mechanism is shown in FIG. 4 and can comprise two hose grippers 13 affixed to a carriage 14 reciprocally-movable, along a rail 15 lead screw or the like, lengthwise of the support 12. In a forwardmost position of the carriage 14, the two grippers 13 are moved into engagement with the waistband of a pantihose garment H mounted on the line closer supporter. This movement may involve one gripper moving downwardly from above the supporter and one upwardly from below. One gripper 13 takes hold of the waistband portion in the region of P while the other takes hold of a diametrically-opposed portion. Once the grippers have hold of the waistband, the carriage 14 is caused to travel (in the direction of arrow X) towards the toe closer turret from which the toe closer supports 12 project. During an initial part of the travel of the carriage 14, the grippers 13 strip the pantihose from the leg supports 11 of the line closer L. During a subsequent part of said travel, the grippers draw the pantihose body onto the two adjacent suction tubes of toe closer support 12. By this time, the pantihose legs 20, 21 are located within the respective suction tubes 12', 12" of the support 12. To assure unhindered mounting on support 12, the grippers 13 may move apart (in the direction of arrow Y) to "open" the body during an appropriate part of the carriage travel.

It will be seen that the toe closer T is so disposed that its supports 12 extend in the direction of the line closer discharge station II. Moreover, as the toe closer turret indexes bringing supports 12 successively to this station, the suction tubes 12', 12" are placed in positions adjacent a delivery end of the apparatus 10.

At the discharge station, the supports 11 of line closer L are in a horizontal plane. The suction tubes 12', 12" may likewise be in a horizontal plane although, depending on the precise construction of the toe closer T, they may be in a vertical plane or in a plane inclined at some other angle between the horizontal and vertical. The apparatus 10 has its delivery end configured according to the disposition of the tubes, so as to deliver each hose leg reliably to the open end of its proper suction tube. Moreover, depending on the angular relationship between the (horizontal) supports 11 of the line closer L and the support tubes 12', 12" of the toe closer T, the stripping and loading mechanism may be required to rotate the hose body through a certain angle in the course of its transfer operation. The normal requirement would be for the body seam to be located equidistantly between the said two suction tubes 12', 12", and in a plane normal to the plane containing the two tubes. Hose rotation can be effected by rotating the grippers 13 as a unit relative to the carriage 14 or to the rail 15, depending on the construction of the stripping and loading mechanism.

The standard line closer L has a circular, horizontal rail encircling its carousel 26. In use, the machine operator mounts the welt ends of two separate legs on the leg supports 11 and drapes the lower leg portions over the rail. The legs remain draped over the rail as the carousel rotates, carrying them towards the discharge station II. In the absence of this invention, it is not possible for the draped legs to be presented properly to the suction tubes 12', 12" at the station II.

The exemplary equipment illustrated includes means to separate the hose legs as they are moved with the carousel 26 towards the discharge station II. The separating means comprises two stationary, arcuate guide rails 28, 30 both of which extend around the periphery of the line closer L to the discharge station II. The first rail 28 extends from the loading station (I). In use, the operator drapes both hose legs over this rail in the course of loading hose onto the line closer L. Rail 28 may be the circular rail already forming part of the commercial Takatori line closer or a modification thereof. Modification may be needed e.g. to dispose its discharge end 29 at a height and radial position suiting a related one of the suction tubes 12" of the toe closer T.

The second rail 30 has an upstream end 31 adjacent but downstream of the loading station I. Upstream end 31 is tapered and is located beside the path B swept by the outer ends of the leg supports 11 as the carousel 26 rotates. Further, said end 31 is positioned such that the two legs 20, 21 extending from the supports 11 to the rail 28 are respectively caused to pass over and under rail 30. Lower leg 21 passes under rail 30 while upper leg 20 passes over rail 30. The end 31 is therefore interposed between the legs 20, 21 moving with the carousel 26.

Away from its end 31, rail 30 curves outwardly and upwardly. When viewed in plan, the rails 28, 30 will be seen to cross at 32. At this point, rail 30 is above rail 28. Beyond 32, proceeding in the direction of discharge station II, the rail 30 continues to curve outwardly until it is disposed both above and radially beyond rail 28. The shape of rail 30 can be considered to be a gentle spiral when viewed in plan, but in reality is a gentle helix.

The outward and upward divergence of rail 30 relative to path B and rail 28 results in the moving hose legs 20, 21 being guided along divergent paths of movement and thereby being separated from one another. Both legs 20, 21 are draped over their respective rails 30, 28 and from point 32 onwards, the hanging portion of leg 20 is radially outside the hanging portion of leg 21.

The rails 28, 30 keep the moving hose legs separate and guide their respective legs thus to the associated suction tube 12' or 12". In the illustrated equipment, at the station II it happens that the suction tubes 12', 12" are in different horizontal and vertical planes. The ends 29, 33 of the rails 28, 30 are similarly spaced apart and are located beside the mouths of their associated tubes (12" and 12' respectively). The arrangement ensures upper hose leg 20 on rail 30 only enters tube 12' while lower leg 21 on rail 28 only enters tube 12".

There will be frictional drag as the legs 20, 21 slide around the rails. The result is that the legs lag behind the moving leg supports 11. For properly timed operation, it is required to control the movement of the legs 20, 21 so that they are already installed in their proper tubes 12', 12" by the time the stripping and loading mechanism places the hose body on the toe closer T. For reliable and repeatable operation, therefore, we provide controlled means to move the legs, the said means comprising two conveyors to be described. These conveyors substantially contribute to the successful loading of the legs into their correct suction tubes and hence are a preferred feature of this embodiment.

Each conveyor 40, 41 comprises an endless belt 42 trained around driven 43 and idler 44 pulleys, and driven by an electric motor preferably of variable speed type.

For clarity of illustration only conveyor 40 is shown in FIG. 1. Both conveyors are shown in FIG. 4. Conveyor 40 advances the hanging portion of upper hose leg 20 along the rail 30 to rail end 33 and thence to the nearer suction tube 12'. Conveyor 41 advances the hanging portion of lower hose leg 21 somewhat beyond the rail end 33 and the nearer suction tube 12', to a position in front of the farther suction tube 12". Conveyor 41 thus advances leg 21 to the end 29 of associated rail 28, and thereupon releases the leg 21 to tube 12".

The conveyors 40, 41 might be continuously or intermittently driven. Each conveyor belt 42 could have its conveying flight running on the associated rail. However, in the preferred embodiment illustrated each of the conveying flights runs against a vertical support panel or skirt 45, 46. Said skirts depend from the rails 28, 30 and extend therealong upstream from their ends 29, 33 to positions in the vicinity of the pulleys 44.

The skirts 45, 46 and conveyors preclude any possibility of the draped hose legs 20, 21 tangling with one another, said skirts assisting the rails therefore in keeping the hose legs separate.

The legs 20, 21 will ordinarily be the same length, of course. Rail 28 is closer to, and rail 30 is farther from, the path B so the length of lower leg 21 which hangs down from rail 28 will be greater than the length of upper leg 20 hanging from rail 30. If conveyor 41 had its conveying flight close and parallel to rail 28 (akin to conveyor 40), it could take hold of a middle part of leg 21 and present that to the suction tube 12″. Presentation of the middle part to the suction tube 12″, rather than a foot or toe end portion of the hose leg 21, could perturb hose transfer to the toe closer T. Accordingly, we position pulley 44 of conveyor 41 lower, relative to rail 28, than pulley 42. The conveyor 41 thus has its conveying flight inclined upwardly to the rail end 29. By this means, the conveyor 41 can be made to take hold of a position of the hose leg 21 closer to the foot or toe end when the leg first reaches the conveyor. The moving conveyor belt 42 then elevates the foot or toe end portion to the region of the suction tube 12″.

At least in the vicinity of the upstream ends of the conveyors, the skirt or panel 45 depending from the upper rail 30 has a sufficient depth, or vertical extent, to ensure the upper leg 20 cannot be seized by the conveyor 41.

If desired, either or both guide rail 28, 30 can have its end or a terminal extension projecting laterally beyond the associated suction tube, to ensure the hose legs cannot inadvertently escape from the influence of suction in the suction tube.

The invention is not limited to the apparatus being associated, as shown, with a line closer and a toe closer. For example, the apparatus 10 could transport hose on a line closer towards a boarding machine located at station II. The apparatus could transport hose, inter alia in the form of socks, towards a boarding machine from a looper line closer. Furthermore, there is no demand that the hose—or other garments—are moving in a circular path when they encounter the present apparatus. The said articles could be moving along a straight path when the limp, hanging portions thereof meet the means which separates them.

Several advantages accrue from the present invention apart from the reduced handling element arising from the automatic transfer of hosiery garments from one machine to the other. Firstly, all the one operator has to do is load leg blanks onto the supports of one machine, i.e. the line closer. The operator does not have to supervise or control transfer to the other machine (the toe closer), since transfer is wholly automatic and the apparatus itself ensures the hose legs are presented to the proper toe closer suction tubes at the proper time. The operator neither has to separate the leg blanks while loading the line closer nor to ensure they remain separated, since the above apparatus separates the legs itself. As is already known, the toe closer can be unloaded without operator intervention. Accordingly the only task incumbent on the operator is that of placing leg blanks on the line closer supports. Such a simple task puts no undue demands on the operator and, thanks to the minimal manual actions, excellent production rates will be attainable.

The invention is not limited, so far as concerns hosiery manufacture, to garment transfer, specifically from a line closer to a toe closer. For example, the transfer or loading apparatus 10 disclosed above could be incorporated in any hosiery conveyor provided in a hosiery manufactory for delivering pantihose to a production machine the needs of which demand that the legs of arriving garments be separated. A toe closer is exemplary of such a machine. Another example is a boarding machine which has a pair of leg forms over which the legs are to be drawn for boarding. One such machine is disclosed in U.S. Pat. No. 4,434,918 to Hodges. Yet another example is a gusset-inserting machine of the general type disclosed in GB No. 2,001,238 to Flude. Such a machine has a gussetting head onto which a body portion of the pantihose is mounted. The gussetting head is conveniently associated with suction tube leg receivers operable while the body portion is being mounted on the gussetting head. Mounting of the body portion is a task fulfilled by a stripping and loading mechanism such as has been described in connection with FIG. 4. The apparatus 10 is primarily designed, however, as a means operatively to link a line closer with a toe closer or with a gusset inserting machine.

Various modifications and various applications of the present invention will occur to the addressee, and such modifications as fall within the novel aspects of this invention are to be regarded within the scope of the invention.

For example, as described above the pantihose body portion remains upon the holders 11 of the line closer L and is not stripped therefrom until after the toe ends of the hose legs 20, 21 have entered their allotted suction tubes. By appropriately controlling the drive means 40, 41, it could be arranged that the toe ends enter the suction tubes 20, 21 after the body portion has been seized by the grippers 13 and thereby released from the holders 11. Such early release of the body portion from the holders 11 may enable the line closer operation to be accelerated beneficially.

In the illustrated embodiment, frictional drive means comprising the conveyors 40, 41 are located adjacent the station whereat the pantihose garment is transferred to the toe closer T, so as to engage or grip the legs of the garment during their final approach to said transfer station. Each conveyor could, however, extend appreciably further upstream than in the accompanying illustrations. This could facilitate proper control of the garment during its movement towards the transfer station, to ensure the individual legs and body portion arrive thereat in properly timed sequence. It may be beneficial for the conveyors to extend as far upstream from the transfer station as the vicinity of the operator's loading station I. The operator will then place the hose legs on their respective supports 11 and offer their limp portions to the respective conveyors therefor. Said conveyors can be trained to run each in contact with a respective one of the opposite sides of a single guide rail. With such an extended conveying means, therefore, the divergent rail 30 could be omitted, and rail 28 alone employed; the depth of this rail would be increased e.g. by a vertical skirt to provide an adequate surface for contact by the conveying means.

I claim:

1. A method of conveying a garment having limp portions to a work station having separate receiving members each allotted to a respective one of the limp portions, the said portions being advanced separated from one another during their passage to the work station, wherein at least in their final approach to the work station, at least one limp portion is engaged by endless loop conveying means and thereupon is positively advanced along said guide means in a controlled manner to its allotted receiving member.

2. A method according to claim 1, wherein the garment is moved along a circular path towards said work station, one limp portion is moved along a substantially circular path defined by a circularly-shaped guide member and a second limp portion is moved along an adjacent path defined by a second guide member having a portion of substantially helical shape.

3. A method according to claim 1, wherein the garment is a pantihose having a body and two legs constituting the limp portions, and wherein the receiving members are a pair of suction tubes, the method further comprising sucking the legs presented separately to the suction tubes thereinto, disposing said pantyhose body around the two tubes and thereafter drawing the pantihose garment over the tubes such that its legs leave the insides of the tubes and enclose the respective suction tubes, whereby the pantihose is supported by said suction tubes in an everted state.

4. A method of conveying a garment having separate limp portions to a work station having separate receiving members for the limp portions each allotted to a respective one of said portions, wherein consequential upon moving the garment in the direction of said station, the limp portions are displaced relative to each other, thereby separating them, by causing them to move along different, diverging paths each leading to a respective one of the separate receiving members, and wherein each separated limp portion is engaged and gripped by endless loop conveying means at least as it approaches a downstream end of its path of travel and thereupon is positively advanced by said conveying means along its path in a controlled manner to its respective receiving member.

5. A method according to claim 4, wherein the limp portions are draped over and moved along associated elongated guide members which diverge from one another and which each terminate adjacent a respective one of said receiving members.

6. A method according to claim 5, wherein two limp portions are draped over and moved along one guide member towards another guide member, the latter guide member having one end so located adjacent said one guide member as to be interposed between the limp portions, and the said latter guide member diverging from said one guide member whereby, in operation, one limp portion becomes draped over the said latter guide member and is caused to follow a different path of movement than the other limp portion which remains draped over said one guide member.

7. A method of producing a pantihose garment from two open-ended leg blanks, comprising the steps of (a) placing the blanks on hose holders of a line closer ready for seaming the leg blanks together, to form a body portion of the garment;

(b) advancing the blanks on the holders towards a discharge station of the line closer whereat is juxtaposed a toe closer having a pair of suction tube hose leg supports to which the garment is to be transferred;

(c) in the course of performing step (b);

(i) moving the leg blanks past a seamer to join the leg blanks and form the body portion of the garment and (ii) conveying the garment to the discharge station in accordance with the method claimed in claim 1, the garment legs being said limp portions of the garment;

(d) transferring the garment on arrival at the discharge station from said line closer holders to the toe closer suction tube supports, the transfer step involving presentation of each garment leg to a respective one of said supports for the legs to be sucked into their allotted supports, stripping the garment body from the line closer holders and placing the body portion around the two toe closer supports in an everted condition;

(e) thereafter closing the toe ends of the two legs by operation of the toe closer.

8. A method according to claim 7, wherein stripping the garment body from the line closer holders occurs before the garment legs are sucked into the toe closer suction tube supports.

9. A method of producing a pantihose garment from two open-ended leg blanks, comprising the steps of (a) placing the blanks on hose holders of a line closer ready for seaming the leg blanks together on this machine, to form a body portion of the garment;

(b) advancing the blanks on the holders towards a discharge station of the line closer whereat is juxtaposed a toe closer having a pair of suction tube hose leg supports to which the garment is to be transferred and, in the course of advancing said blanks, moving them past a seamer to join the leg blanks and form the body portion of the garment, (c) transferring the garment on arrival at the discharge station from the liner closer holders to the toe closer suction tube supports the transfer step involving first stripping the garment body from the line closer holders immediately thereafter presenting each garment leg to a respective one of said supports for the legs to be sucked into their alloted supports, and finally placing the body portion around said two supports in an everted condition.

10. Garment handling apparatus operable on garments moving between two work stations, wherein said garments have adjacent limp portions to be delivered individually to separate receiving members at the receiving station, the apparatus comprising means to advance a garment towards the receiving members, guide means defining predetermined paths along which said limp portions are to move to said receiving members, and endless loop conveying means positioned for frictional engagement with at least one limp portion during at least the final approach of the garment to the receiving members, said conveying means being operative positively to advance the at least one associated limp portion individually in a controlled manner along its respective path to its allotted receiving member.

11. Apparatus according to claim 10 wherein said guide means comprise divergent rails, one for each limp portion, said guide means extending to said receiving members.

12. Apparatus according to claim 11, wherein there are two rails one of which has an end located adjacent an intermediate portion of the other rail, such that in operation when two limp portions of said garment draped over said other rail are advanced therealong towards said end of said one rail, the latter rail is interposed between said limp portions and thereafter said limp portions are draped one over each rail.

13. Apparatus according to claim 12, wherein said garment advancing means are operative to advance said garment around a circular path of movement, said other rail is of circular shape, and said one rail extends upwardly and outwardly from its said end relative to said other rail to deflect a limp portion draped thereover upwardly and outwardly from the limp portion draped over said other rail.

14. Pantihose manufacturing equipment including the garment handling apparatus according to claim 10, and wherein said receiving work station comprises a suction everter having two suction tubes to which the said apparatus is operative to deliver a pair of hose legs of the pantihose which legs constitute said limp portions, said equipment further comprising means to take hold of a pantihose body portion when located at said station and to place said body portion in an encircling position supported on said suction tubes in readiness for the garment to be drawn fully onto said tubes and thereby be everted.

15. Equipment according to claim 14 wherein said suction everter is an integral part of a hosiery toe closer.

16. Equipment according to claim 14, wherein a first of said work stations, comprises a line closer for joining together pairs of hose leg blanks, said line closer having movable leg supports which serve to advance the said garment towards the receiving work station, whereat said suction everter is located.

17. Pantihose manufacturing equipment comprising the garment handling apparatus according to claim 10, wherein a first of said work stations is a line closer for joining together pairs of hose leg blanks, the garment advancing means of said apparatus comprise movable leg supports of the line closer and the other work station comprises a machine which performs another hosiery manufacturing operation, said machine having a pair of suction tubes constituting said receiving members which receive the hose legs of a pantihose garment in the course of mounting a body portion thereof on the said machine, said garment handling apparatus being associated with an automatic transfer facility for transferring the body portion of said pantihose garment from said line closer to said machine.

18. Pantihose manufacturing equipment comprising (a) a line closer having hose holders for receiving a pair of hose leg blanks and a seamer, said holders being movable along a predetermined path to advance the blanks first past said seamer which is operative to join said blanks to form a pantihose body portion, and then to a transfer station; (b) apparatus according to claim 10 for advancing at least one limp leg portion of said blanks positively and controllably to said station; (c) a toe closer adjacent said transfer station for receiving the pantihose garment in readiness for closing toe ends of the legs thereof, said toe closer having a pair of suction tubes each to receive therein, by suction, a respective garment leg which is advanced thereto by said conveying means of the said apparatus; and (d) a transfer mechanism at said transfer station operative (i) to strip the body portion of the garment from the line closer holders and (ii) to carry said body portion to the suction tubes and to dispose the body portion around said tubes in an everted condition.

19. Equipment according to claim 18 wherein said transfer mechanism is operative to take hold of said body portion and to strip it from the line closer holders before the legs are presented to said suction tubes.

20. Garment handling apparatus operable on garments moving between two work stations, wherein said garments having adjacent limp portions to be delivered separated from one another to separate receiving members at the receiving station, the apparatus comprising means to advance a garment towards the receiving members, elongate guide means extending to the receiving members, said guide means having a configuration adapted to effect a relative separating displacement of said limp portions in the course of their movement therealong towards the receiving members, and respective endless loop conveying means to engage and frictionally grip each limp portion during at least the final approach of said garment to the receiving members, said conveying means being operative positively to advance the associated limp portions individually in a controlled manner along said guide means to their allotted receiving members.

21. Pantihose manufacturing equipment comprising (a) a line closer having hose holders for receiving a pair of hose leg blanks and a seamer, said holders being movable along a predetermined path to advance the blanks first past said seamer which is operative to join said blanks to form a pantihose body portion, and then to a transfer station; (b) a toe closer adjacent said transfer station for receiving the pantihose garment in readiness for closing toe ends of the legs thereof, said toe closer having a pair of suction tubes each to receive therein, by suction, a respective garment leg, and (c) a transfer mechanism at the transfer station operative (i) to strip the body portion of the garment from the line closer holders and (ii) to carry said body portion to the suction tubes and to dispose said body portion around said tubes in an everted condition, said transfer mechanism being operative to take hold of said body portion and to strip it from the line closer holders immediately before the legs are presented to the suction tubes.

22. Garment handling apparatus operable on garments moving between two work stations, wherein said garments have adjacent limp portions to be delivered individually to separate receiving members at the receiving station, the apparatus comprising means to advance the garment towards the receiving members, guide means defining predetermined paths along which said limp portions are to move to said receiving members, and respective endless loop conveying means positioned to engage said limp portions during at least the final approach of the garment to the receiving members and to positively advance said limp portions to their respective receiving members.

23. A method of conveying a garment having limp portions to a work station having separate receiving members each allotted to a respective one of the limp portions, the said portions being advanced separated from one another, wherein at least in their final approach to the work stations, the limp portions are each engaged by endless loop conveying means and are individually and positively advanced in a controlled manner to its allotted receiving member.

24. Pantihose handling apparatus operable on pantihose moving between a line closer where blank hose legs are joined to generally form a pantihose garment and a gusset insertion machine, said line closer having hose leg supports which receive the hose leg blanks, said supports being movable along the line closer along a predetermined path towards a pair of suction tubes on the gusset insertion machine each of which constitutes a receiving member for one of the hose legs of the pantihose garment, elongated guide means located along said predetermined path of movement, said guide means being configured such that movement of said hose legs therealong causes consequential separating displacement of the hose legs, and endless loop conveying means positioned to engage at least one of said hose legs at least during the final approach to said suction tubes whereby one of said hose legs is presented to one of said suction tubes and the other of said hose legs is presented to the other of said suction tubes.

25. Garment handling apparatus operable on garments moving between two work stations, wherein said garments have adjacent limp portions which are to be delivered separated from one another to separate receiving members at one of said work stations, the apparatus comprising means to advance the garments along a path of movement towards the receiving members, elongate guide means extending to the receiving members, said guide means comprising divergent rails, one for each limp portion, divergence of said rails coupled with movement of the limp portions draped thereover being operative to separate said limp portions and driving means extending along a downstream delivery part of each rail and engagable by said limp portion draped over the associated rail for positively advancing the limp portions along the downstream parts of their guiding rails at controlled speeds of approach towards the receiving members, said driving means comprising driven conveying belt means operatively associated with said rails.

* * * * *